United States Patent [19]

Schiffer

[11] 4,178,782

[45] Dec. 18, 1979

[54] DEVICE FOR PRINTING BY SUBLIMATION

[75] Inventor: Günter Schiffer, Krefeld, Fed. Rep. of Germany

[73] Assignee: Kleinewefers Gesellschaft mit beschränkter Haftung, Krefeld, Fed. Rep. of Germany

[21] Appl. No.: 825,427

[22] Filed: Aug. 17, 1977

[30] Foreign Application Priority Data

Aug. 25, 1976 [DE] Fed. Rep. of Germany ..... 2638128

[51] Int. Cl.[2] ..... B44C 1/16; D06P 1/00; D06B 1/14

[52] U.S. Cl. ..... 68/5 D; 8/2.5 A; 101/470

[58] Field of Search ..... 101/470; 8/2.5 A; 68/5 C, 5 D

[56] References Cited

U.S. PATENT DOCUMENTS

| | | | |
|---|---|---|---|
| 2,783,175 | 2/1957 | Smith et al. | 101/470 |
| 3,768,280 | 10/1973 | Kannegiesser | 101/470 |
| 3,915,628 | 10/1975 | Bossard et al. | 101/470 |
| 4,056,352 | 11/1977 | Mayer | 101/470 |

FOREIGN PATENT DOCUMENTS

| | | | |
|---|---|---|---|
| 1227681 | 4/1971 | United Kingdom | 101/470 |
| 1387417 | 3/1975 | United Kingdom | 101/470 |
| 1423358 | 2/1976 | United Kingdom | 8/2.5 A |

OTHER PUBLICATIONS

JSDC; Possibilities of Vacuum Technology, JSDC, Dec. 1973, pp. 474–485.

*Primary Examiner*—Clyde I. Coughenour
*Attorney, Agent, or Firm*—Becker & Becker, Inc.

[57] ABSTRACT

A device for printing in a continuous manner upon a web of textile material by sublimation of the dyestuff of a dyestuff carrier which is pressed against the web of textile material and which during the printing operation is by a pressure belt pressed into engagement with a heated surface of a drum over which the dyestuff carrier passes. The pressure belt is permeable to air and other gaseous substances whereas the heated engaging surface of the drum or the dyestuff carrier is air or gas impermeable.

According to a particularly advantageous embodiment of the above mentioned device that region of the pressure belt which is in heating contact with the drum is in communication with a vacuum or is under atmospheric pressure.

5 Claims, 5 Drawing Figures

DEVICE FOR PRINTING BY SUBLIMATION

The present invention relates to a device for continuously printing upon a web of textile material by sublimation of the dye stuff of a dye stuff carrier which by means of a band is pressed against the web of textile material and which during the printing process engages a heated engaging surface.

German Auslegeschrift 2 005 186 discloses a method of printing upon webs or pieces of textile material, especially knit fabrics containing synthetic fibers, according to which the material to be printed upon is covered by a dye stuff carrier carrying the dye stuff. The material and the dye stuff carrier are pressed against each other while at the same time heat acts upon the same, and the transfer of the dye stuff from the dye stuff carrier to the material is effected by sublimation of the dye stuff. For a gentle treatment of the pressure sensitive material and also for obtaining a greater penetration depth of the dye stuff molecules into the textile material, it is provided in this instance that that side of the dye stuff carrier which faces away from the material is subjected to an underpressure, while in view of the atmospheric overpressure acting upon the printing foil the material and the printing foil are pressed together and at the same time the gases or vapors generated during the heating up of the printing foil are withdrawn through the material to be printed upon. In this connection, a perforated roller mantle is employed. The heat has to be conveyed to the printing foil while passing through the pressure band.

A further development of the above described method is disclosed in German Offenlegungsschrift 2 156 154 and French Patent No. 2 176 318. According to this further development, the dye stuff carrier is gas permeable, and at both sides of the web of material such a pressure differential is created that an air or gas current passes through the web of textile material from the front side to the rear side thereof. For a continuous treatment of a web of textile material difficulties are being encountered with this development which can be mastered only by great skill and experience in this field and which cannot be mastered with all kinds of webs of material. In this connection, the heat effect, the speed of the web of textile material, the pressure differential or the suction, the dye concentration and the dye have an influence upon each other.

It is, therefore, an object of the present invention to provide a device by means of which the penetration of the dye molecules into the web of textile material can be realized without a relatively complicated structure, and by means of which the printing upon the web of textile material by sublimation of the dye stuff can be obtained by simple means.

Figure 1:
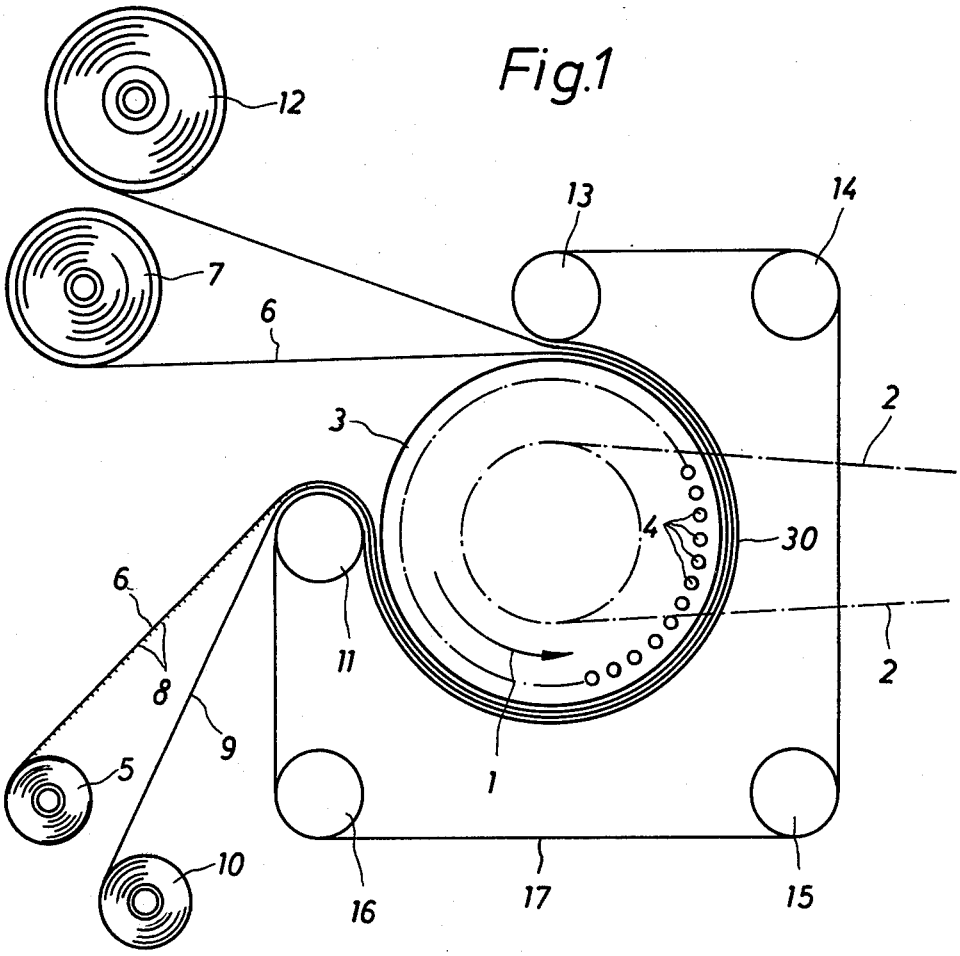

This object and other objects and advantages of the invention will appear more clearly from the following specification in connection with the accompanying drawings, in which:

FIG. 1 diagrammatically illustrates in view a device according to the invention with which the dye stuff carrier is passed around an inwardly heated drum upon which the web of textile material is pressed resting while the web of textile material is by means of a pressure band against the dye stuff carrier.

Figure 2:
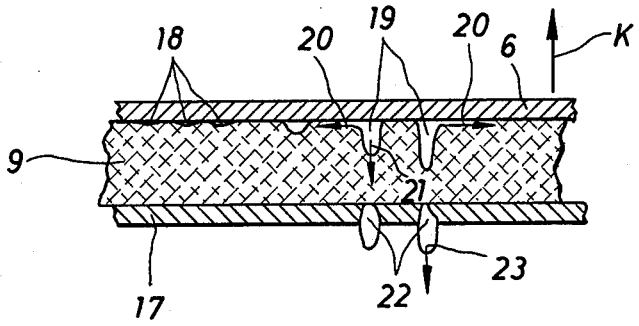

FIG. 2 is a section through the web of textile material and the pressure band while the sublimation and the escape of air from the web of textile material are indicated.

Figure 3A:
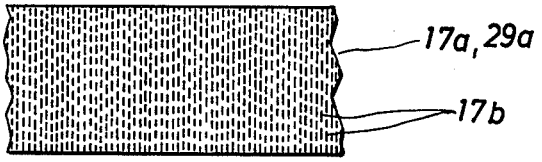
Figure 3:
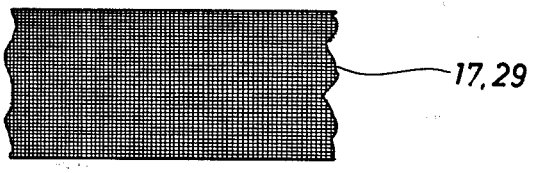

FIGS. 3 and 3*a* respectively illustrate a top view of two embodiments of the pressure band.

Figure 4:
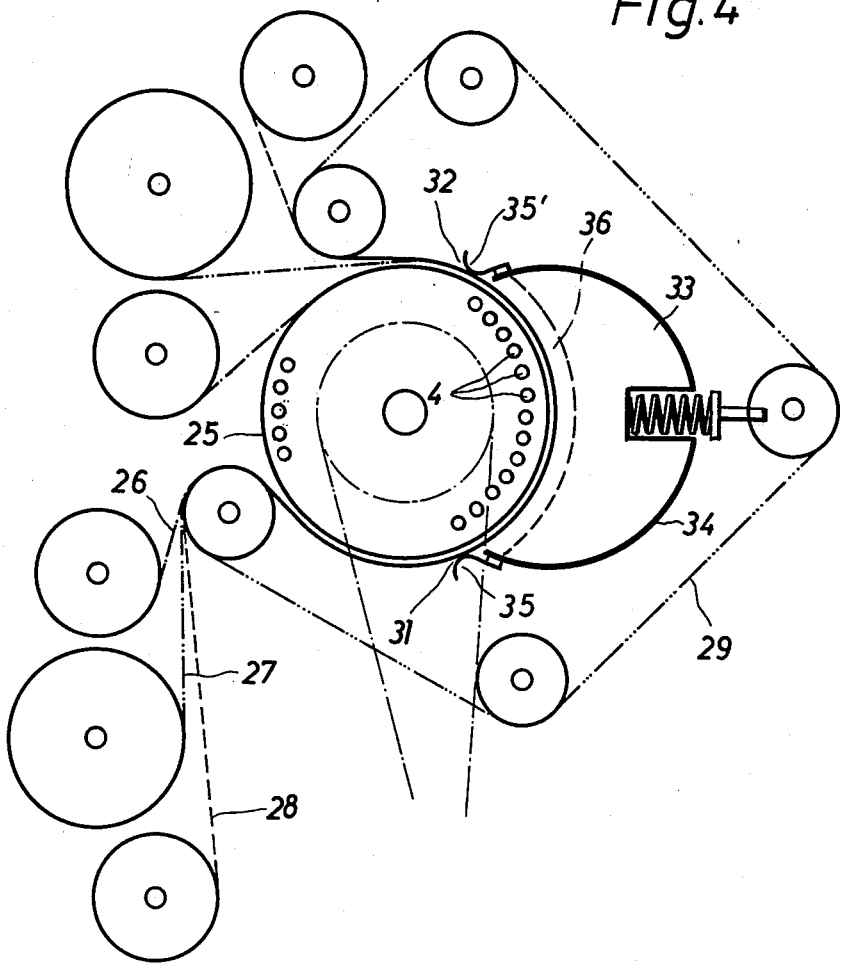

FIG. 4 shows a modified device according to the invention in which a portion of the inwardly heated drum around which the dye stuff carrier and the web of textile material are looped is surrounded by a vacuum chamber, while between the pressure band and the web of textile material there is passed a protective paper band.

The device according to the present invention for continuously printing upon a web of textile material by sublimation of the dye stuff of a dye stuff carrier pressed against the web of textile material, while the dye stuff carrier during the printing process engages a heated engaging surface, is characterized primarily in that the pressure band is gas permeable, in that the heated engaging surface or the dye stuff carrier are gas permeable and in that the region of the device at the level of the engaging surface is subjected to atmospheric pressure or a vacuum.

German Offenlegungsschrift 2 213 559 discloses the printing upon webs of textile material by sublimation of a dye stuff of a dye stuff carrier which rests on an inwardly heated roller, while the web of textile material is by means of a pressure band pressed from the outside against the printing foil. This process is based on the assumption that the printing upon a web of textile material would be all the more excellent the higher the pressure at which the web of textile material is pressed against the dye stuff carrier and thus the pressure band presses the web of material at a high pressure against the dye stuff carrier. For this purpose an endless felt belt has been employed as pressure band which, however, with extended use became stiff, felted and accordingly less and less air permeable. In contrast thereto, the present invention is based on the finding that a strong pressing of the web of textile material against the printing foil is less important and that it is far more essential that the dye gas generated during the sublimation will have the possibility to freely, i.e. without material resistance, press out of the web of textile material an equal quantity of air absorbed by the web of textile material. In other words, the dye gas should be able to expand freely and thus unimpededly to penetrate into the web of textile material. For this purpose the web of textile is to be pressed against the dye stuff carrier merely at such a pressure that the web of textile material will closely engage the dye stuff carrier and that no dye stuff gas will laterally escape from the pattern so that a blurring of the pattern will be prevented. If care is taken that the generated quantity of dye gas can practically entirely enter into the web of textile material while the same quantity of air can unimpededly escape from the web of textile material at that side thereof which faces away from the dye stuff carrier, it will be assured that without the aid of suction and throughflow means a fast and position-true penetration of the dye molecules into the web of textile material takes place. The parameter "suction" or "pressure differential between front and back side of the web of textile material", which with heretofore known methods had to be taken into consideration, is in the present case immaterial so that exclusively the effect of the heat upon the printing foil, the speed at which the web of textile material passes through the device, and the type and concentration of the dye remain to be considered.

According to a further development of the invention the pressure band is provided with perforations. A woven band of metallic or synthetic fibers has been found to be advantageous as a pressure band because on the one hand it possesses the necessary gas permeability and on the other hand has the necessary pull resistance to be able to press the web of textile material against a dye stuff carrier passed over an inwardly heated roller. It contradicts the general opinion of an expert in the field of textile printing to have a metal band under pressure directly engage a web of textile material.

If the web of textile material is rather surface sensitive so that a metal band would not be desirable, the device according to the present invention may provide that between the gas permeable pressure band and the web of textile material there is interposed a gas permeable protective band, for instance a band of paper. This protective band and the gas permeable band are so adapted to each other that the quantity of air which corresponds to the generated quantity of dye gas can freely and unimpededly escape from the web of textile material.

The sublimation of the dye stuff on the dye stuff carrier can be effected in a vacuum in a known manner ("Organikum" organischchemisches Grundpraktikum (organic-chemical basic practical course), 3rd revised edition 1964, VEB Deutscher Verlag der Wissenschaften, Berlin. In this connection neither a suction nor a flow through the web of textile material occur.

Referring now to the drawings in detail, the device illustrated therein comprises a roll or drum 3 which by means of a driving chain 2 is rotated in the direction of the arrow 1. On the inside of said drum 3 there are provided heating means which are circularly arranged and may for instance consist of heat radiating means 4 by means of which the drum mantle will be heated.

The device furthermore comprises a roll 5 from which a dyestuff carrier 6 is withdrawn in a continuous manner and which is looped directly around the drum 3, said dyestuff carrier 6 being wound upon a roll 7. The dyestuff carrier 6 has that side thereof which faces away from the drum 3 and faces toward the web of textile material 9 provided with a dye coat 8 adapted to be sublimated.

The web of textile material is withdrawn from a roll 10 and similar to the dyestuff carrier 6 is passed about a deviating roll 11 and while closely engaging the dyestuff carrier 6 is conveyed to the roll 12.

Around the roll 11 as well as the rolls 13, 14, 15 and 16 is passed an endless pressure belt 17 which is adapted to permit a gaseous substance including air to pass therethrough. The structure of said belt 17 is indicated by way of example in FIGS. 3 and 3*a*. Belt 17 has the necessary pull strength so that the web 9 of material will be firmly pressed against the dyestuff carrier 6 without said web of textile material being subjected to a harmful pressure. The pressure at which the web of textile material is by means of the belt 17 pressed against the dyestuff carrier 6 is merely sufficient to prevent a lateral escape of the sublimating gas between the dyestuff carrier 6 and the web of textile material.

FIG. 2 illustrates on a somewhat larger scale than FIG. 1 the transfer of the dye molecules onto the web of textile material within the region between the rolls 11 and 13, i.e. over the engaging surface of the drum 3. The first solid dyestuff particles 18 of the dyestuff coat on the dyestuff carrier 6 sublimate and form a gas volume 19 which cannot escape through the tight dyestuff carrier 6 (in FIG. 2 upwardly in the direction of the arrow K), nor can the gas in view of the web of textile material 9 being pressed against the dyestuff carrier 6 by the belt 17 escape in the direction of the arrows 20 between the dyestuff carrier 6 and the web of textile material 9 which otherwise might laterally blur the pattern of said web of material. The quantity 19 of the gas can freely expand only in the direction of the arrow 21, since air 22 of the same or nearly the same quantity can escape from the web 9 of textile material through the air or gas permeable pressure belt 17 in the direction of the arrow 23.

With the embodiment according to FIG. 4, there is again provided a drum 25 which by means of a heat source, for instance circularly arranged heat radiating means, is heated on the inside. Passed around said drum 25 are dyestuff carrier 26 and the web 27 of textile material resting on said dyestuff carrier 26, and an air or gas permeable protective belt 28 engaging and resting upon the web 27 of textile material. Also in this instance, the endless pressure belt 29 is air or gas permeable so that, as illustrated in FIG. 2, the gas volume formed on the dyestuff carrier 26 will be able to press an equal quantity of air out of the web 27 of textile material which air passes through the protective belt 28 which preferably consists of paper, and through the pressure belt 29 which two, as mentioned above, are air and gas permeable. The protective belt 28 as well as the pressure belt 29 are so selected with regard to each other that the displaced air can from the web of textile material freely flow off toward the outside.

According to the embodiment of FIG. 1, the outside 30 of the pressure belt 17 as well as the outside of the dyestuff carrier 6 and of the web 9 of textile material are surrounded by the outer atmosphere. With the embodiment of FIG. 4, over the region between the areas 31 and 32, i.e. over the engaging surfaces of the dyestuff carrier 26 the web 27 of textile material, the protective belt 28 and the engaging belt 29 on the drum 25 are surrounded by a vacuum chamber 33. This vacuum chamber comprises a cap 34 the longitudinal edges of which at 35, 35' resiliently engage the pressure belt 30, and the transverse edges 36 of which rest on the drum surface outside the dyestuff carrier 26, the web 27 of textile material, the protective belt 28, and the pressure belt 29. In view of the vacuum formed in the chamber 33, the sublimation is aided without a suction being created through the web of textile material.

In connection with the present invention, a pressure belt and protective belt are considered air and gas permeable when such pressure belt and protective belt are able within a certain time unit to permit a quantity of air or gas to pass from that side of the respective belt which faces the web 9 of textile material to its free side with said air or gas quantity equalling or approximately equalling the dye-gas quantity which forms on the dyestuff carrier 6 and enters the web of textile material as indicated in FIG. 2.

The belt 17 of FIG. 1 and the belt 29 of FIG. 4 may be a woven metal belt or a woven synthetic belt (shown in FIG. 3 on an enlarged scale), while the weaving density is such that the above mentioned gas and air permeability is assured. A similar belt is shown in FIG. 3*a* which belt is provided with small openings 17*b* likewise assuring the required gas and air permeability. The protective belt may be of the same type as the pressure belt 17,29 and 17*a*, 29*a* although it may be of a material different from that of the pressure belts. The protective belt 28 may likewise be a fabric belt but preferably is a belt with punched-out perforations.

For the sake of completeness, it may be added that while in FIGS. 1 and 4 the various belts and webs are shown separated from each other and while also the outer drum surface is shown spaced from the adjacent dyestuff carrier, this way of showing was selected merely to better illustrate the individual parts. Actually, the various belts, webs and dyestuff carriers engage each other and the dyestuff carrier is also in engagement with the drum.

It is, of course, to be understood that the present invention is, by no means, limited to the specific showing in the drawings but also comprises any modifications within the scope of the appended claims.

What I claim is:

1. A device for printing in a continuous manner upon a web of textile material by sublimation of dyestuff, which includes in combination: a rotatable drum provided with heating means for heating the outer peripheral surface of said drum, pressure belt operable to pass around a portion of said peripheral surface of said drum and in spaced relationship to said peripheral surface so as to define with the latter a passage for receiving a dyestuff carrier adjacent to said peripheral surface and a web of textile material to be printed upon between said dyestuff carrier and said pressure belt, and roller means for supplying said dyestuff carrier and web of textile material into said passage and withdrawing same therefrom, said pressure belt being permeable to a gaseous substance and being operable to engage and press a web of textile material and a dyestuff carrier both received in said passage against each other and the dyestuff carrier against said outer peripheral surface of said drum and regionally at level of the peripheral surface there being a gaseous pressure differential effective peripherally thereof, a strong pressing of the web of textile material being less important than that essentially dye gas generated during sublimation has the possibility freely and without material resistance to press out of the web of textile material an equal quantity of air absorbed by the web and thus unimpededly to penetrate into the web of textile material pressed against said dyestuff carrier merely at such a pressure that the web of textile material closely engages said dyestuff carrier and that dyestuff gas is kept from laterally escaping from the pattern so that blurring of the pattern is prevented, a protective belt permeable to a gaseous medium and extending between said drum and said pressure belt and directly engaged by the latter, and a vacuum chamber encompassing at least a section of that portion of said peripheral outer drum surface which is passed around by said pressure belt.

2. A device in combination according to claim 1, in which said pressure belt is a belt provided with perforations.

3. A device in combination according to claim 1, in which said pressure belt is a woven belt of synthetic material.

4. A device in combination according to claim 1, in which said pressure belt is a woven metallic belt.

5. A device in combination to claim 1, in which at least a section of that peripheral outer drum surface which is passed around by said pressure belt is exposed to atmospheric pressure.

* * * * *